US006188361B1

(12) United States Patent
George et al.

(10) Patent No.: US 6,188,361 B1
(45) Date of Patent: Feb. 13, 2001

(54) ACTIVE ANTENNA PANEL OF MULTILAYER STRUCTURE

(75) Inventors: Sëbastien George, Fonsegrives; Patrice Ulian, Latrape, both of (FR)

(73) Assignee: Alcatel, Paris (FR)

( * ) Notice: Under 35 U.S.C. 154(b), the term of this patent shall be extended for 0 days.

(21) Appl. No.: 09/411,229

(22) Filed: Oct. 4, 1999

(30) Foreign Application Priority Data

Oct. 5, 1998 (FR) ..... 98 12457

(51) Int. Cl.[7] ..... H01Q 1/38
(52) U.S. Cl. ..... 343/700 MS; 343/853
(58) Field of Search ..... 343/700 MS, 853, 343/873, 893; 342/375

(56) References Cited

U.S. PATENT DOCUMENTS

| | | | | |
|---|---|---|---|---|
| 4,977,406 | * | 12/1990 | Tsukamoto et al. | 343/700 MS |
| 5,453,751 | * | 9/1995 | Tsukamoto et al. | 343/700 MS |
| 5,471,220 | | 11/1995 | Hammers et al. | 342/375 |

FOREIGN PATENT DOCUMENTS

| | | |
|---|---|---|
| 0 398 555 A2 | 11/1990 | (EP) . |
| 0 620 613 A2 | 10/1994 | (EP) . |

OTHER PUBLICATIONS

P. Ulian et al, "3D Active Modules for High Integration Antennas" Proceedings of the European Microwave Week, Including 28$^{th}$ European Microwave Conference, vol. 1, Oct. 5–6, 1998, pp. 271–276, XP002106338.

F. Coromina et al, "New Multibeam Beamforming Networks for Phased Array Antennas Using Advanced MMCM Technology", 1996 IEEE MTT–S International Microwave Symposium Digest, San Francisco, Jun. 17–21, 1996,vol. 1, Jun. 17, 1996, pp. 79–82, XP000704868.

P. Monfraix et al, "3D Microwave Modules for Space Applications", 1998 IEEE MTT–S International Microwave Symposium Digest, vol. 3, Jun. 7–12, 1998, pp. 1289–1292, XP002106340.

* cited by examiner

*Primary Examiner*—Tan Ho
(74) *Attorney, Agent, or Firm*—Sughrue, Mion, Zinn, Macpeak & Seas, PLLC

(57) ABSTRACT

The invention relates to an active antenna panel comprising an array of n radiating elements and a multilayer-structure m-beam distributor designed to feed the n radiating elements, the distributor having first "formation" layers for supporting beam-forming means, and second "connection" layers designed to support first electrical connection means for interconnecting the first layers, and second electrical connection means for connection to the radiating elements. In the invention the forming layers extend substantially perpendicularly to the main plane of the antenna, the forming layers and the connection layers are assembled together by molding so that the beam distributor constitutes a single block, and the radiating elements are connected directly to the second connection means.

4 Claims, 5 Drawing Sheets

ACTIVE ANTENNA PANEL OF MULTILAYER STRUCTURE

The invention relates to an active antenna panel of multilayer structure.

It relates particularly but not exclusively to active antenna systems for satellites designed to handle one or more beams via a single panel of radiating elements by means of a beam distributor of multilayer structure.

BACKGROUND OF THE INVENTION

Such satellite active antenna systems need to be of ever-increasing complexity in terms specifically of the number of beams (m) handled by a single radiating panel (of n radiating elements). The complexity and the missions of the beam distributor are thus increased, since it becomes necessary firstly to provide power division from m×1 to m×n, and secondly to provide recombination from m×n to 1×n:

- routing then becomes more dense and thus more difficult, particularly when providing identical electrical path lengths for all of the signals; losses increase inevitably; and
- the presence of a plurality of beams make it necessary for the illumination law of each pencil in terms of amplitude and phase to be handled within the distributor itself, between the division and recombination functions, which makes it essential to integrate chips (attenuator, phase shifter) within the distributor.

Finally, the inevitable increase in frequency makes the techniques and technologies that have traditionally been used less and less suitable for implementing active antenna distributors.

At present, so-called organic multilayer printed circuit board (PCB) technologies are those which are most suited to the beam distributor problem. Nevertheless, they turn out to be more or less inappropriate under certain conditions, such as:

- when the operating frequency exceeds 20 GHz. Under such circumstances, the RF multilayer interconnection techniques usable in that technology (in particular plated-through holes (PTHs)) are limited by the present state of the art; and
- for chip integration within the distributor itself since the method of making multilayer PCBs (lamination, pressure, thermofusion) is generally incompatible with any component in relief that it is desired to insert in the multilayer structure. This drawback makes it necessary to offset the chips outside the distributor.

Finally, distributors are built using a horizontal stacking model for the layers parallel to the plane of the antenna, which gives rise to major constraints on performance (generally narrow band) and the space occupied by the interconnections with the radiating elements which are then disposed perpendicularly to the distributor.

Such interconnection can be provided only via the edges of the circuit, which constitutes a major drawback for a "horizontal" distributor: increased losses to take signals to the edges are unacceptable, and the routing density on the edges which offer very little room provides no simplification compared with other solutions.

OBJECTS AND SUMMARY OF THE INVENTION

The invention thus seek to mitigate the above-mentioned drawbacks.

The invention thus provides an active antenna panel that allows chips to be integrated without difficulty within the distributor itself.

Another object of the invention is to provide such a panel of size in terms of interconnections and circuits that is small compared with prior art solutions.

To this end, the invention provides an active antenna panel having a main plane and including an array of n radiating elements and a multilayer-structure m-beam distributor for feeding the n radiating elements, the distributor having first "forming" layers for supporting beam-forming means, and second "connection" layers for supporting first electrical connection means for interconnecting the first layers, and second electrical connection means for connection to the radiating elements.

According to the invention:

- the forming layers extend substantially perpendicularly to the main plane of the antenna;
- the forming layers and the connection layers are assembled together by molding so that the beam distributor constitutes a single block; and
- the radiating elements are connected directly to the second connection means.

This vertical multilayer topology using molding technology enables the coplanar RF three-dimensional interconnection to be reused by one of the connection layers, the only technique presently known for three-dimensional transition that provides high performance over a broad band width. This thus makes it possible to envisage a broad range of applications without any variation in concept or technology.

In an embodiment, the single block is a flat rectangular parallelepiped, the connection layers extending substantially parallel to the plane of the antenna and including a front connection layer having the second connection means and a rear connection layer having the first connection means, the radiating elements being fitted directly on said front connection layer.

The RF three-dimensional interconnection zone of the edges of the "horizontal" solutions are thus offset towards the front and rear connection layers of the distributor, which layers are much more roomy.

RF three-dimensional interconnection routing then becomes very simple and much easier to optimize. In addition, the same area is available as in horizontal multilayer technology for the purpose of conveying signals.

BRIEF DESCRIPTION OF THE DRAWINGS

Other characteristics of the invention are explained in the following description of an embodiment given solely by way of example, with reference to the accompanying figures.

MORE DETAILED DESCRIPTION

The active antenna panel 1 comprises an array of radiating elements 2 and a beam distributor 3.

In the embodiment shown, the array of radiating elements 2 comprises 64 radiating elements 2*i* distributed in an 8×8 matrix. These radiating elements 2*i* are made using a three-dimensional technology known to the person skilled in the art. They are therefore not described in greater detail.

Figure 1B:
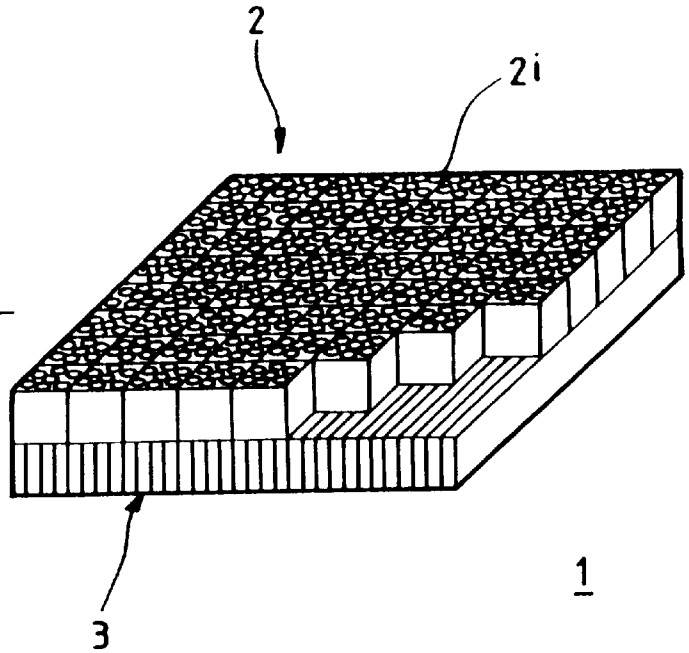
FIG. 1*b* is a diagrammatic perspective view of the FIG. 1*a* active antenna in which the radiating elements are shown included.
Figure 1A:
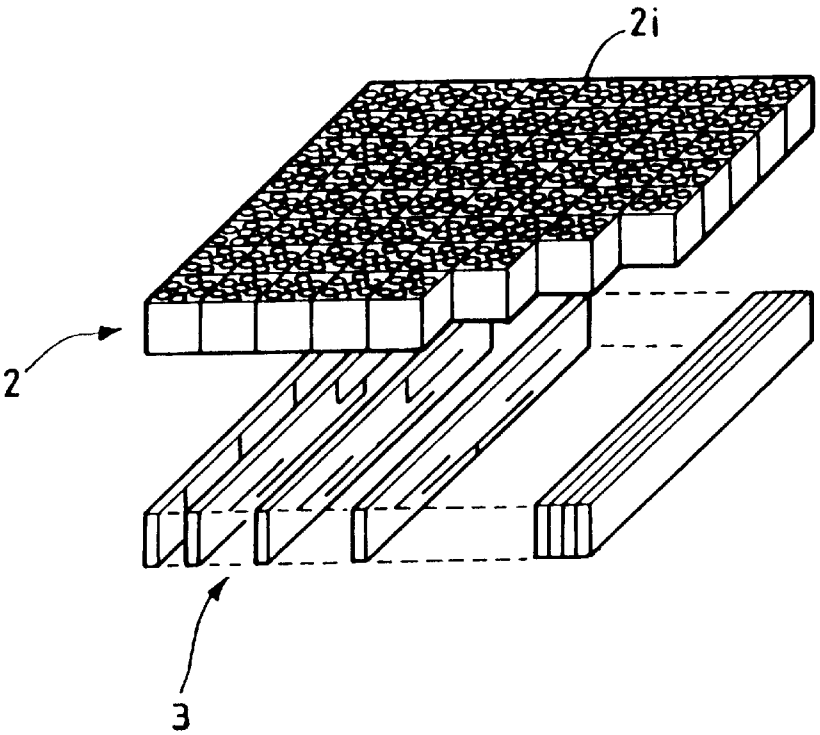
FIG. 1*a* is a diagrammatic perspective view of an active antenna panel of the invention in which the radiating elements are shown separately.
Figures 2A, 2B:
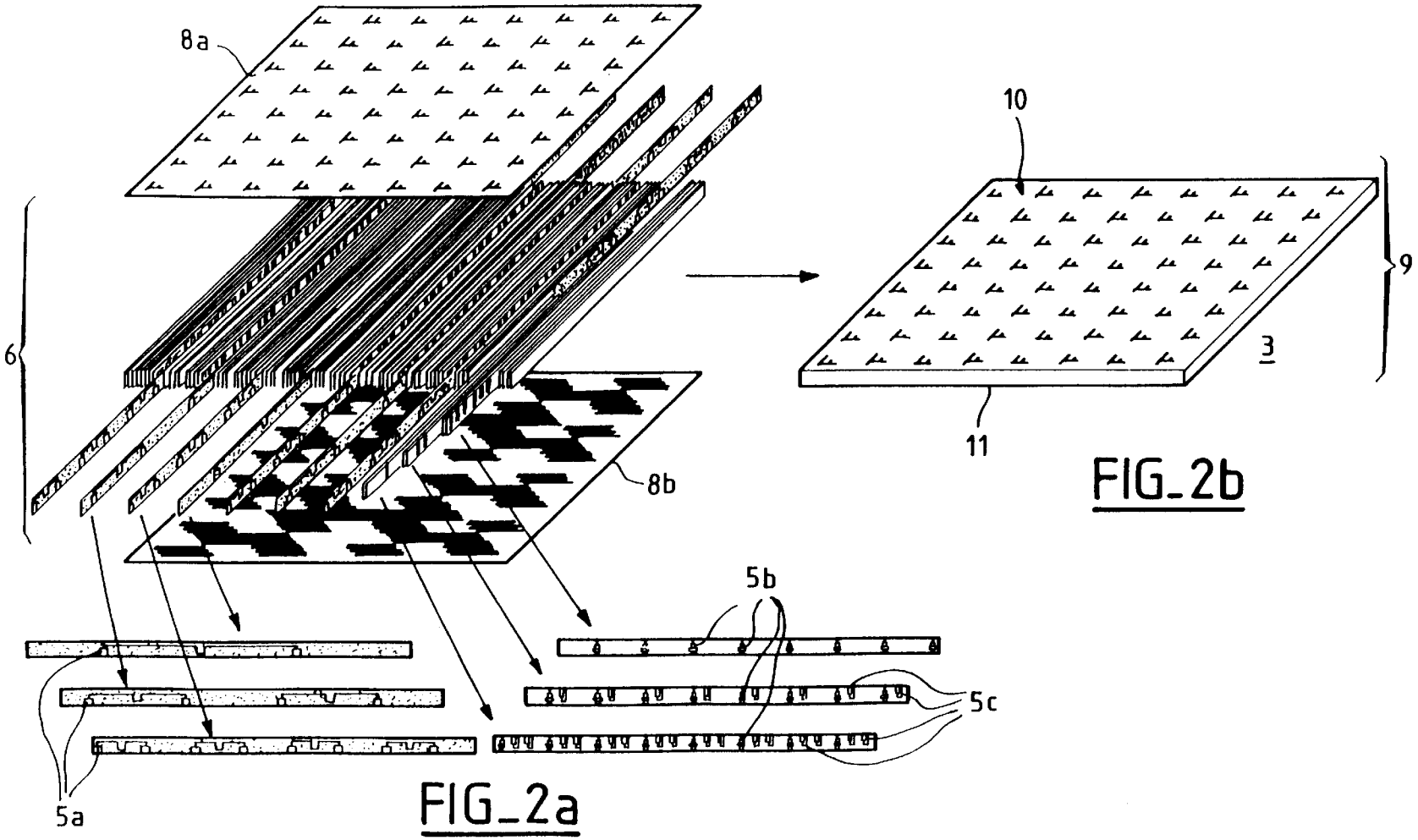
FIG. 2*a* is an exploded diagrammatic view in greater detail of the active antenna of FIGS. 1*a* and 1*b*.
FIG. 2*b* is a diagrammatic view of the FIG. 2*a* panel after the various layers have been molded.
Figure 3A:
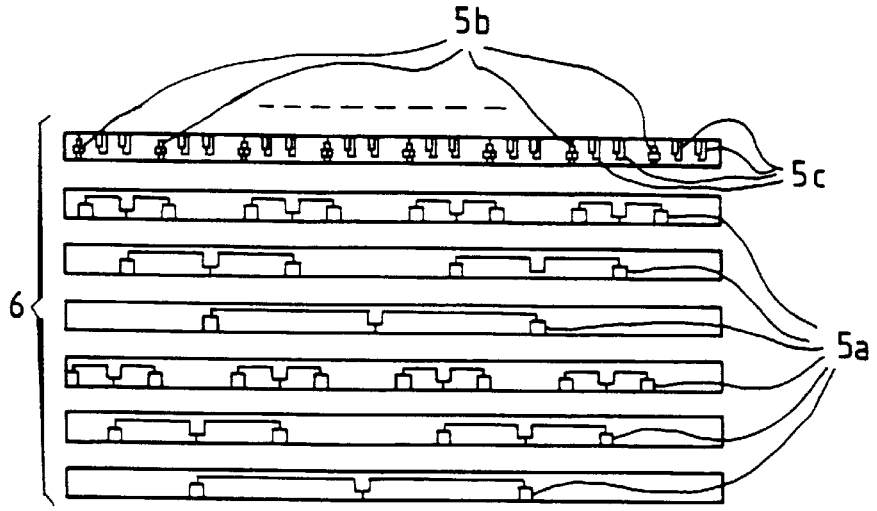
FIGS. 3*a,* 3*b,* and 3*c* are diagrams showing the various layers forming an active antenna panel of the invention.
Figure 3B:
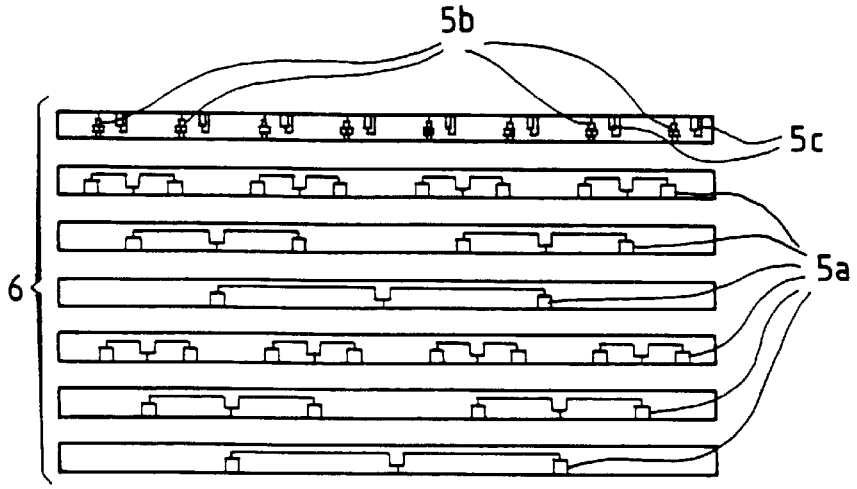
Figure 3C:
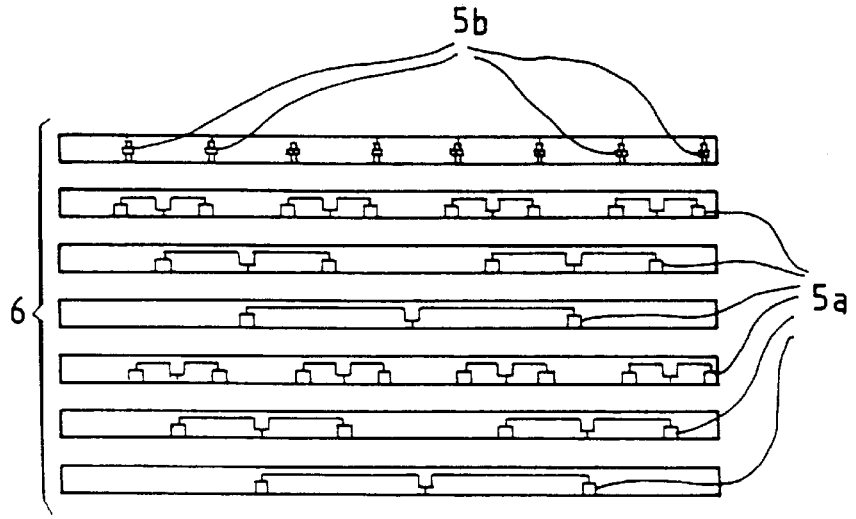
Figure 4A:
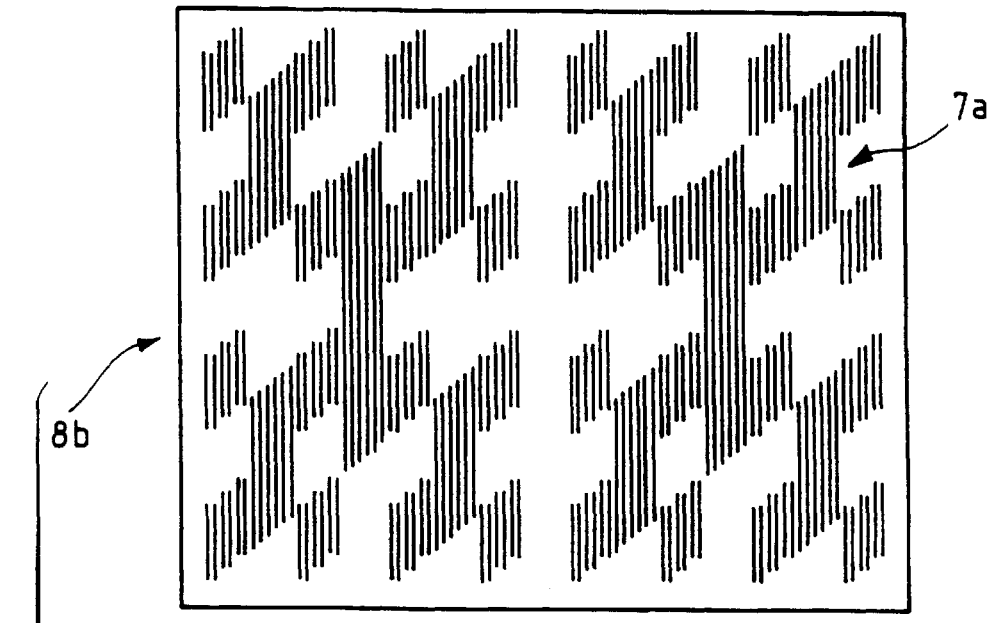
FIGS. 4*a* and 4*b* are diagrams showing different embodiments of the connection layers of an active antenna panel of the invention.
Figure 4B:
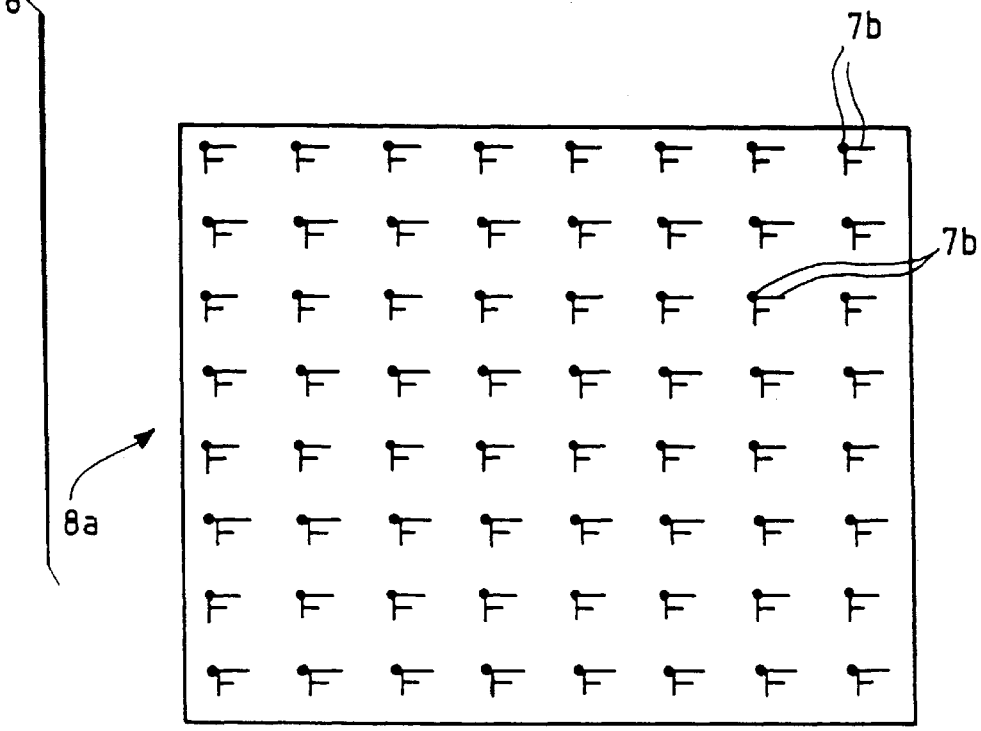
Figure 5:
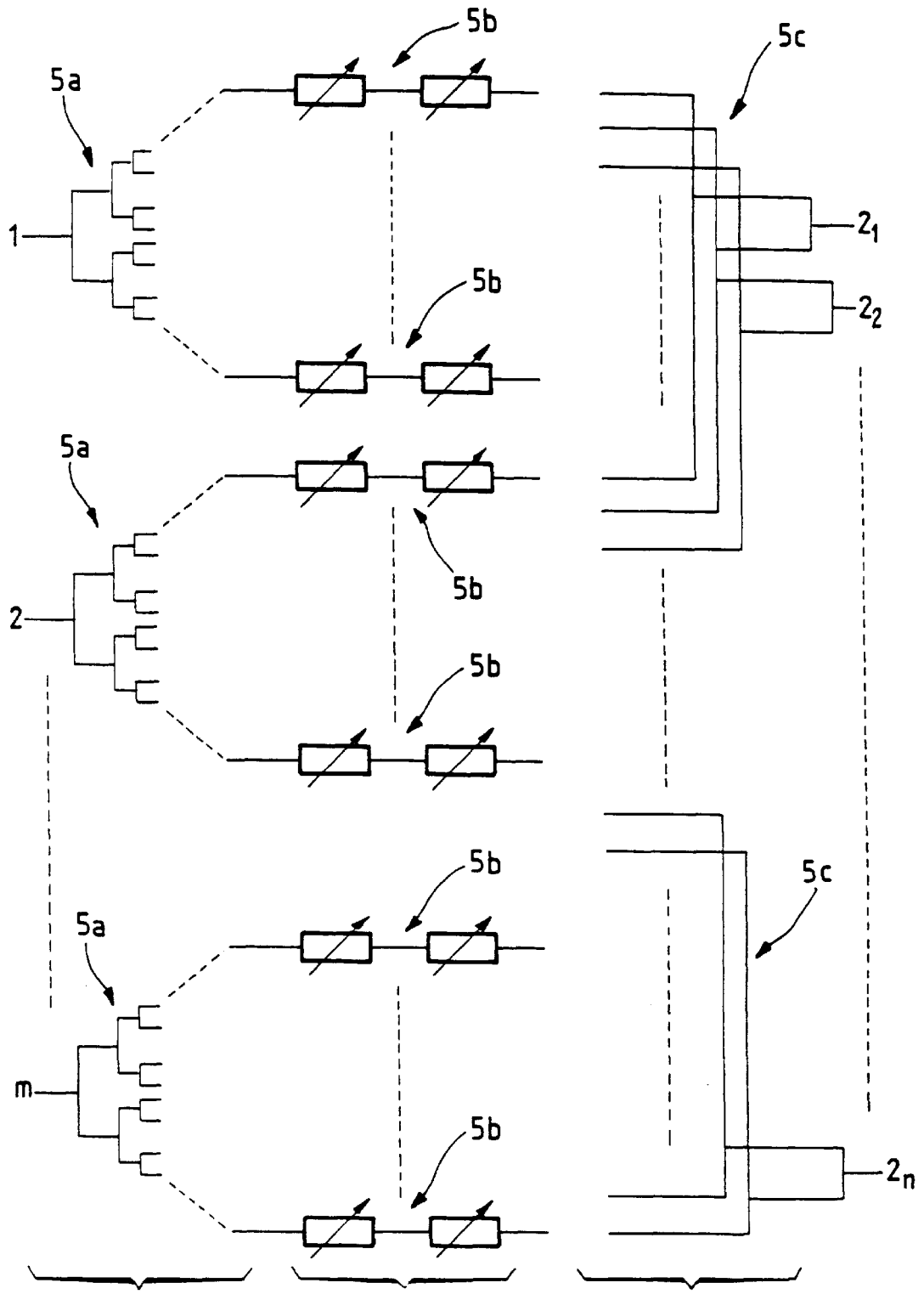
FIG. 5 is an electric circuit diagram of the various functions implemented in the beam distributor of an antenna panel of the invention.

The beam distributor 3 is designed to feed the radiating elements 2*i* with m beams, where m is an integer greater than or equal to 1. In the embodiment shown in FIG. 2*a,* m is equal to 6.

To feed the radiating elements 2*i,* the beam distributor 3 implements the following functions:

- it divides the power from the m RF signal sources (not shown);
- it processes the divided power both in phase and in amplitude so as to generate the desired beam direction or "squint" from the radiating elements 2*i;* and
- after it has performed phase and amplitude processing it recombines the power so as to feed the radiating elements 2*i* in order to obtain said desired squint.

These functions are performed by forming means comprising power division means 5*a,* optionally occupying a plurality of levels, phase and amplitude processing means 5*b,* and recombination means 5*c,* optionally occupying a plurality of levels. These forming means are supported by first layers referred to as "forming" layers 6.

The distributor 3 also performs the following electrical connection functions:

- the power division means 5*a* are connected to the RF signal sources;
- the various power division levels are interconnected;
- the power division means 5*a* are connected to the processing means 5*b;*
- the processing means 5*b* are connected to the recombination means 5*c;*
- the various recombination levels are interconnected; and
- the recombination means 5*c* are connected to the radiating elements 2*i.*

These connection functions are performed by connection means comprising:

- first connection means 7*a* connecting the power division means 5*a* to the RF signal sources, connecting the various power division levels to one another, and connecting the power division means 5*a* to the processing means 5*b;* and
- second connection means 7*b* connecting the processing means 5*b* to the recombination means 5*c,* connecting the various recombination levels to one another, and connecting the recombination means 5*c* to the radiating elements 2*i.*

The connection means are supported by second layers referred to as "connection" layers 8.

In the invention, the forming layers 6 and the connection layers 8 are assembled together by molding so that the beam distributor constitutes a single block 9, the forming layers 6 extending substantially perpendicularly to the main plane of the antenna.

In the embodiment shown, the single block 9 is a flat rectangular parallelepiped having two large faces 10 and 11 of area corresponding to that of the matrix of radiating elements 2*i.*

In this configuration, the connection layers 8 include a front connection layer 8*a* having the second connection means 7*b* and a rear connection layer 8*b* having the first connection means 7*a,* the radiating elements 2*i* being fitted directly on said front connection layer 8*a.*

Naturally, the various forming means 5*a,* 5*b,* and 5*c* can be made using any technology available to the person skilled in the art, for example such as microwave frequency multilayer PCB technology.

The same applies to the connection circuits 7*a* and 7*b.*

What is claimed is:

1. An active antenna panel having a main plane and including an array of n radiating elements and a multilayer-structure m-beam distributor for feeding the n radiating elements, the distributor comprising first forming layers for supporting beam-forming means, and second connection layers for supporting first electrical connection means for interconnecting the first layers, and second electrical connection means for connection to the radiating elements, wherein:

- the forming layers extend substantially perpendicularly to the main plane of the antenna,
- the forming layers and the connection layers are assembled together by molding so that the beam distributor constitutes a single block, and
- the radiating elements are connected directly to the second connection means.

2. An active antenna panel according to claim 1, wherein the single block is a flat rectangular parallelepiped, the connection layers extending substantially parallel to the plane of the antenna and including a front connection layer having the second connection means and a rear connection layer having the first connection means, the radiating elements being fitted directly on said front connection layer.

3. An active antenna panel as described in claim 1, wherein the beam-forming means comprises:

- a power division means;
- a phase and amplitude processing means; and
- a recombination means.

4. An active antenna panel as described in claim 1, wherein the connection layers comprise:

- a front connection layer for supporting the second electrical connection means; and
- a rear connection layer for supporting the first electrical connection means.

* * * * *